US008568563B1

(12) United States Patent
Bennett

(10) Patent No.: US 8,568,563 B1
(45) Date of Patent: Oct. 29, 2013

(54) METHODS OF MAKING A NON-WOVEN FIRE BARRIER MAT

(71) Applicant: Johns Manville, Denver, CO (US)

(72) Inventor: Glenda Beth Bennett, Toledo, OH (US)

(73) Assignee: Jonhs Manville, Denver, CO (US)

( * ) Notice: Subject to any disclaimer, the term of this patent is extended or adjusted under 35 U.S.C. 154(b) by 0 days.

(21) Appl. No.: 13/740,666

(22) Filed: Jan. 14, 2013

(51) Int. Cl.
*D21H 13/40* (2006.01)
*D21H 21/34* (2006.01)
*D21H 23/28* (2006.01)

(52) U.S. Cl.
USPC ..... 162/145; 162/149; 162/156; 162/158; 162/159; 162/165; 162/168.1; 162/169; 162/184

(58) Field of Classification Search
USPC ..... 162/141, 145, 149, 152, 156, 158, 162/164.1, 165, 168.1, 169, 183–185, 159
See application file for complete search history.

(56) References Cited

U.S. PATENT DOCUMENTS 3,622,445 A * 11/1971 Heidweiller ..... 162/145
3,766,003 A * 10/1973 Schuller et al. ..... 162/156
4,129,674 A * 12/1978 Hannes et al. ..... 442/373
4,849,281 A * 7/1989 Brandon et al. ..... 442/341
5,045,385 A * 9/1991 Luckanuck ..... 428/220
5,236,778 A * 8/1993 Landis et al. ..... 442/68
5,484,653 A * 1/1996 Kennedy et al. ..... 442/415
5,837,620 A * 11/1998 Kajander ..... 442/63
5,840,413 A * 11/1998 Kajander ..... 428/292.1
6,267,843 B1 * 7/2001 Helwig et al. ..... 162/145
6,365,001 B1 * 4/2002 Helwig et al. ..... 162/135
6,551,951 B1 * 4/2003 Fay et al. ..... 442/82
6,770,169 B1 * 8/2004 Wallace ..... 162/156
6,875,308 B2 * 4/2005 Kajander et al. ..... 162/135
6,884,321 B2 * 4/2005 Erb et al. ..... 162/145
7,285,183 B2 * 10/2007 Kajander et al. ..... 162/135
7,462,259 B2 * 12/2008 Kajander et al. ..... 162/135
7,547,375 B2 * 6/2009 Jaffee et al. ..... 162/156
7,829,488 B2 * 11/2010 Bennett ..... 442/386
8,257,554 B2 * 9/2012 Poggi et al. ..... 162/164.6
8,283,266 B2 * 10/2012 Jaffee et al. ..... 442/172
2003/0031854 A1 * 2/2003 Kajander et al. ..... 428/304.4
2005/0070186 A1 * 3/2005 Shoemake et al. ..... 442/176
2005/0112978 A1 * 5/2005 Jaffee et al. ..... 442/415
2005/0136241 A1 * 6/2005 Kajander et al. ..... 428/316.6
2006/0283565 A1 * 12/2006 Kajander et al. ..... 162/101
2007/0039703 A1 * 2/2007 Lee et al. ..... 162/156
2007/0105467 A1 * 5/2007 Bennett ..... 442/141

(Continued)

FOREIGN PATENT DOCUMENTS

EP 1283299 A2 * 2/2003 ..... D21H 23/28
EP 2083129 A2 * 7/2009 ..... E04C 2/04
JP 2003183999 A * 7/2003 ..... D21H 23/28

*Primary Examiner* — Jose Fortuna
(74) *Attorney, Agent, or Firm* — Robert D. Touslee

(57) ABSTRACT

Methods of making the burnthrough resistant non-woven mat include forming the mat from glass fibers and at least two binders, a first binder having a vinyl component and a second binder having a strengthening component. The vinyl component may be, for example, ethylene vinyl chloride, and the strengthening component may be, for example, melamine formaldehyde. In one method, the vinyl component is added to the glass fibers by a beater addition process and the strengthening component is sprayed onto the glass fibers. The burnthrough resistant non-woven mat may be used in conjunction with an insulation blanket, and may be especially suited to use in insulating aircraft.

16 Claims, 4 Drawing Sheets

(56) References Cited

U.S. PATENT DOCUMENTS

| | | | | |
|---|---|---|---|---|
| 2007/0271889 | A1* | 11/2007 | Jaffee | 55/524 |
| 2008/0083522 | A1* | 4/2008 | Poggi et al. | 162/158 |
| 2009/0071617 | A1* | 3/2009 | Huang et al. | 162/156 |
| 2009/0159228 | A1* | 6/2009 | Law et al. | 162/157.4 |
| 2009/0186549 | A1* | 7/2009 | Bennett | 442/348 |
| 2010/0221973 | A1* | 9/2010 | Ketzer et al. | 442/412 |
| 2012/0312366 | A1* | 12/2012 | Starry et al. | 136/256 |
| 2013/0045352 | A1* | 2/2013 | Kern et al. | 428/76 |

* cited by examiner

METHODS OF MAKING A NON-WOVEN FIRE BARRIER MAT

BACKGROUND

The present disclosure relates methods of making to a burnthrough resistant non-woven mat, and in particular to a lightweight burnthrough resistant non-woven mat for use in thermal and acoustical insulation blankets used in commercial aircraft and in other applications requiring burn through resistance properties of the type or similar to those properties currently required for commercial aircraft.

Commercial aircraft manufacturers and aircraft regulatory agencies in the United States have established combined thermal, acoustical, component and composite small scale flammability, fire barrier, fire propagation, smoke toxicity, moisture management, weight, fabricate-ability, health and cost requirements for insulation blankets. In particular, the Federal Aviation Administration (FAA) insulation burnthrough test is defined at www.fire.tc.faa.gov and by the test method to evaluate the burnthrough resistance characteristics of aircraft thermal/acoustic insulation materials when exposed to a high intensity open flame provided in §25.856 and 14 C.F.R. §25, Appendix F, Part VII and Advisory Circular 25.856-2A. The fire penetration resistance requirements of thermal/acoustic insulation used in transport category airplanes manufactured after Sep. 2, 2007, became effective Sep. 2, 2009.

U.S. Pat. No. 6,884,321 discloses a flame and heat resistant paper having high burnthrough prevention capability and prepared from modified aluminum oxide silica fibers, in addition to other components. While U.S. Pat. No. 6,884,321 discloses that the basis weight of the paper may range from about 5 to about 250 lb/3000 $ft^2$ (i.e., about 5 to about 250 pounds per ream), U.S. Pat. No. 6,884,321 also discloses that a paper as light as 5 pounds per ream may not pass burnthrough requirements, and that it may be advantageous to use multiple layers of a very thin lightweight paper, and that air space between such layers may prove desirable, for example, in the heat flux portion of the burnthrough test.

There remains a need for a lightweight aircraft blanket that responds to and meets all of the regulatory, aircraft manufacturer and aircraft operator requirements and expectations. The burnthrough resistant non-woven mat set forth in this patent application allows for assembly of such a lightweight blanket.

SUMMARY

According to one aspect, a fire barrier mat is provided. The fire barrier mat includes a nonwoven mat of glass fibers, and a binder including a vinyl component and a strengthening component.

According to another aspect, an insulation product is provided. The insulation product includes an insulation blanket and a fire barrier mat adjacent one side of the insulation blanket. The fire barrier mat comprises a nonwoven mat of glass fibers and a binder that further includes a vinyl component and a strengthening component.

According to another aspect, a method of making a fire barrier mat is provided. The method comprises providing fine glass fibers having an average diameter less than 4 microns, providing coarse glass fibers having an average diameter greater than 6 microns, forming a mat of the fine and coarse glass fibers using a wet lay process, and drying the mat.

According to yet another aspect, a method of making a fire barrier mat includes adding a plurality of binders to the glass fibers, such as by adding a binder to the glass fibers through a beater addition process and then spraying an additional binder onto the fibers.

DETAILED DESCRIPTION

Fiber Compositions

Figure 1:
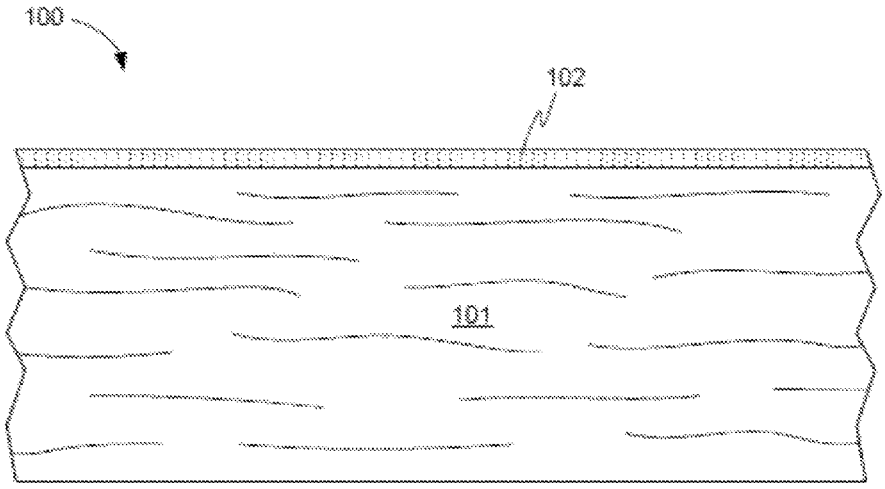
FIG. 1 illustrates a cross section of a first embodiment of an insulation product comprising an insulation blanket and a fire barrier mat.

It has been surprisingly discovered that a lightweight non-woven mat of fine diameter inorganic (e.g., high silica content) fibers can be made to possess good burnthrough resistance properties. As used herein, the phrase "fine diameter" means having an average fiber diameter of less than about four microns. Fine diameter fibers generally have an average fiber diameter of at least about 0.2 microns. In an embodiment, the fine diameter fibers have an average fiber diameter of less than about two microns. Fine diameter high silica content (i.e., comprising greater than about 93 weight %, for example, greater than about 95 weight % or greater than about 97 weight %, $SiO_2$) fibers can be formed by a leaching process with a sodium silicate glass precursor, for example. Fine diameter high silica content fibers possess good high temperature resistance due to high viscosity and corresponding high softening and melting temperatures.

An exemplary fine diameter high silica content fiber is Q-Fiber™, available from Johns Manville, Denver, Colo. Q-Fiber™ is an amorphous, exceptionally pure fibrous silica material. Q-Fiber™ is formed from high-silica-content sand which is melted, fiberized, acid-washed to remove impurities, rinsed, dried, and heat-treated for structural integrity. Q-Fiber™ provides an excellent combination of physical properties including purity, resilience, light weight, as well as resistance to crystal formation, thermal shock, and heat flow. Extremely high in $SiO_2$ content (99.7 weight % after processing), chemically stable Q-Fiber™ will not devitrify in response to elevated temperatures and rapid thermal cycling. Q-Fiber™ Amorphous High-Purity Silica Fiber imparts high thermal efficiency with low weight. Q-Fiber™ also resists thermal shock damage from drastic temperature fluctuations. Typical fiber diameter ranges from 0.75 to 1.59 microns but the process is amenable to a wider range of average fiber diameters. The chemical composition of Q-Fiber™ can comprise ≥99.50 weight % (for example, ≥99.680 weight %) $SiO_2$, ≤0.20 weight % (for example, ≤0.130 weight %) $R_2O_3$ (wherein R is Al, Fe, and/or B), ≤0.10 weight % (for example, ≤0.013 weight %) $TiO_2$, ≤0.1 weight % (for example, ≤0.044 weight %) $Fe_2O_3$, ≤0.10 weight % (for example, ≤0.020 weight %) $Na_2O$, ≤0.10 weight % (for example, ≤0.005 weight %) $K_2O$, ≤0.10 weight % (for example, ≤0.032 weight %) CaO, ≤0.10 weight % (for example, ≤0.011 weight %) MgO, and ≤0.10 weight % (for example, ≤0.010 weight %) B.

In an embodiment, the fine diameter inorganic fiber is formed from a high-iron glass composition as disclosed in U.S. patent application Ser. Nos. 11/893,191 and 11/893,192, the contents of which are hereby incorporated by reference in their entireties. More specifically, the fine diameter inorganic fiber can comprise: (1) about 33-47 weight % $SiO_2$; about 18-28 weight % $Al_2O_3$; about 5-15 weight % $Fe_2O_3$; greater than or equal to about 2 weight % and less than 10 weight % $R_{20}$; about 8-30 weight % CaO; and less than 4 weight % MgO; wherein $R_2O$ represents alkali metal oxides; or (2) about 52-65 weight % $SiO_2$; less than or equal to 4 weight % $Al_2O_3$; about 7-16 weight % $Fe_2O_3$; greater than 6 weight % and less than or equal to about 14 weight % $R_{20}$; about 6-25 weight % CaO; less than or equal to 10 weight % MgO; and about 10-25 weight % RO; wherein $R_2O$ represents alkali metal oxides and RO represents alkaline earth metal oxides. In an embodiment, the fine diameter inorganic fiber are made from crystallizable glass comprising greater than about 5 weight % iron oxide.

In an embodiment, the presently disclosed burnthrough resistant non-woven mat comprises both fine diameter high silica content fiber (e.g., Q-Fiber™) and fine diameter inorganic fiber formed from a high-iron glass composition as disclosed in U.S. patent application Ser. Nos. 11/893,191 and 11/893,192.

As used herein, the phrase "burnthrough resistant" means that use of the presently disclosed non-woven mat as a fire barrier material in construction of an insulation blanket provides a test specimen that passes the FAA insulation burnthrough test. For example, an insulation blanket constructed with the presently disclosed non-woven mat as a fire barrier material and two layers of 1 inch thick 0.42 lb/ft$^3$ fiberglass insulation material would pass the FAA insulation burnthrough test, while two layers of 1 inch thick 0.42 lb/ft$^3$ fiberglass insulation material without the presently disclosed non-woven mat as a fire barrier material would fail the FAA insulation burnthrough test, for example, in about thirty seconds. According to 14 C.F.R. §25, Appendix F, Part VII, Subpart h, the FAA insulation burnthrough test requires that: (1) the insulation blanket test specimens must not allow fire or flame penetration in less than 4 minutes; and (2) the insulation blanket test specimens must not allow more than 2.0 Btu/ft$^2$-sec (2.27 W/cm$^2$) on the cold side of the insulation specimens at a point 12 inches (30.5 cm) from the face of the test rig. In an embodiment, the presently disclosed non-woven mat, if tested as the insulation blanket test specimen in the FAA insulation burnthrough test, would not allow fire or flame penetration in less than 4 minutes.

Thus, the presently disclosed burnthrough resistant non-woven mat can be used as a fire barrier material along with insulation material (e.g., low density fiberglass insulation material) in an insulation blanket meeting the FAA insulation burnthrough requirements that are effective Sep. 2, 2009. The insulation blanket assembly for use in aircraft typically consists of several layers of fiberglass insulation material of various densities loosely encapsulated in a polymer cover film. The presently disclosed burnthrough resistant non-woven mat can also be used as a loose insert or as a component of insulation cover film. Thus, the burnthrough resistant non-woven can be laminated to the outboard cover film, laminated to the outboard side of the insulation material, or inserted loosely between the insulation and the cover film on the outboard side.

An exemplary fiberglass insulation material to which the presently disclosed burnthrough resistant non-woven mat can be bonded is MICROLITE® AA, MICROLITE® AA Premium, and MICROLITE® AA Premium NR, available from Johns Manville, Denver, Colo. MICROLITE® AA Premium NR is a lightweight, flexible, thermal and acoustical insulation material designed to provide the ultimate in noise reduction at minimal weight. MICROLITE® AA Premium NR is formed from resin-bonded borosilicate biosoluble glass fibers. MICROLITE® AA Premium NR, bonded with a thermosetting phenolic resin, is non-flaming and meet industry and government standards for smoke density, smoke toxicity and total heat release. MICROLITE® AA Premium NR is furnished in densities of 0.34 lbs/ft$^3$ (1 inch thick), 0.50 lbs/ft$^3$ (1 inch thick), and 1.250 lbs/ft$^3$ (⅜ inch thick). In an embodiment, the fiberglass insulation material has a density of about 0.29-1.20 lbs/ft$^3$.

As the addition of coarse fibers aids in providing good non-woven mat integrity at low area weight, it has further been surprisingly discovered that the addition of coarse fibers can be used to create a burnthrough resistant non-woven mat with improved mechanical integrity (e.g., tensile strength). As used herein, the phrase "coarse fibers" means fibers having an average fiber diameter of greater than about six microns. Coarse fibers include, for example, chopped strand basalt-based glass fibers, high silica fibers formed by a leaching process similar to that of Q-Fiber™, and ceramic fibers such as 3M™ Nextel™. In an embodiment, the presently disclosed burnthrough resistant non-woven mat comprising coarse fibers has a tensile strength of at least about 3 lbs/in, for example, at least about 5 lbs/in.

Basalt chopped strand glass fibers can be melted from a variety of basalt rock types and formed into continuous fibers through a multi-orifice bushing, then fed to a chopper, for example. Basalt glass fibers possess high temperature resistance due to rapid crystallization when exposed to heat. The fibers having an average fiber diameter of greater than about six microns can also be made from crystallizable glass comprising greater than about 5 weight % iron oxide and/or comprise silica fibers comprising greater than about 93 weight %, for example, greater than about 95 weight %, silica.

Typically, the coarse fibers are formed by a continuous filament process and are larger than six microns. In contrast, the fine diameter fibers are formed by discontinuous wool fiber processes and could have average fiber diameters as high as six microns, though it would be unlikely that the fine wool fiber would be larger than four microns average diameter.

The combination of fine and coarse high temperature resistant fibers provides mechanical integrity, airflow resistance, and thermal dimensional stability that would not exist with individual components. The presently disclosed burnthrough resistant non-woven mat can be made with any number of different organic or inorganic binder systems to improve mechanical integrity at low and/or high temperatures.

A mat comprising fine diameter high silica content fibers, and optionally chopped strand basalt fibers, has much better flexibility and is less brittle than ceramic fiber papers. The presently disclosed burnthrough resistant non-woven mat has an area weight of less than about 150 g/m$^2$, for example, less than about 120 g/m$^2$, less than about 100 g/m$^2$, less than about 70 g/m$^2$, or about 40-60 g/m$^2$. In an embodiment, the presently disclosed burnthrough resistant non-woven mat, used as a fire barrier material, is laminated to fiberglass insulation material (or laminated to the insulation cover film) and has an area weight of about 40-60 g/m$^2$.

The presently disclosed burnthrough resistant non-woven mat can be designed through selection of organic and/or inorganic binders to meet the flammability and flame propagation requirements of components used in aircraft thermal and acoustical insulation. Details of the flammability and flame propagation requirements can be found in §25.856 and 14 C.F.R. §25, Appendix F, Part VII and Advisory Circular 25.856-2A.

In an embodiment, an opacifier such as silicon carbide, titania, kaolin clay, or $SiO_2$ fume can be added to the mat to reduce the heat penetration into and through the mat. The opacifier content can range, for example, up to about 15 weight % of the non-woven mat.

The following examples are intended to be exemplary and non-limiting.

Fiber Examples

Table 1 shows non-woven mat fiber compositions tested using a lab scale mimic of the FAA insulation burnthrough test. The mimic of the FAA insulation burnthrough test uses a flame with slightly higher temperature than the FAA insulation burnthrough test and is carried out for a longer duration than the FAA insulation burnthrough test. In particular, parameters of the mimic of the FAA insulation burnthrough test include sample size of 12"×12", two 1" layers of 0.42 lb/ft$^3$ fiberglass insulation behind the burnthrough non-woven, temperatures of 2000° F.±100° F., burner cone of 2.5" in diameter, and required time for passing of 10 minutes.

The Q-Fiber™ used in the Samples A through J was comprised of 99.7 weight % $SiO_2$, and had an average fiber diameter of 0.5 to 2 microns. The high-iron content fiber used in Samples J and K was comprised of 39.1 weight % $SiO_2$; 23.4 weight % $Al_2O_3$; 8.6 weight % $Fe_2O_3$; 0.5 weight % $TiO_2$; 4.8 weight % $Na_2O$; 4.2 weight % $K_2O$; 9.0 weight % $R_{20}$; 17.7 weight % CaO; 1.6 weight % MgO; and 19.3 weight % RO; wherein $R_2O$ represents alkali metal oxides and RO represents alkaline earth metal oxides, and had an average fiber diameter of 0.8 to 1.2 microns. The basalt fiber used in the Samples E through K had an average fiber diameter of 13 microns.

TABLE 1

| Sample | A | B | C | D | E | F | G | H | I | J | K |
|---|---|---|---|---|---|---|---|---|---|---|---|
| Q-fiber ™ (g/m$^2$) | 120 | 67 | 95 | 58 | 55 | 23 | 20 | 15 | 25 | 37 | 0 |
| Basalt Fiber (g/m$^2$) | 0 | 0 | 0 | 0 | 55 | 47 | 20 | 40 | 24 | 37 | 55 |
| High-Iron Content Fiber (g/m$^2$) | 0 | 0 | 0 | 0 | 0 | 0 | 0 | 0 | 0 | 37 | 55 |
| Total Fiber (g/m$^2$) | 120 | 67 | 95 | 58 | 110 | 70 | 40 | 55 | 49 | 111 | 110 |
| Tensile Strength (lbs/in) | | | 2.6 | 1.2 | | 7.1 | 3.5 | | | 8.9 | |
| Mimic Burnthrough Test | Pass | Pass | Pass | Pass | Pass | Pass | Pass | Pass | Pass | Pass | Pass |

Additionally, sample I was tested as a cover film at the FAA laboratory and passed the FAA insulation burnthrough test. In particular, the non-woven burnthrough barrier was laminated to the outboard (flame side) cover film and the insulation consisted of two 1" layers of 0.42 lb/ft$^3$ fiberglass insulation.

Samples C and D, comprised solely of Q-fiber® and having no coarse basalt fiber exhibited tensile strengths of 2.6 lbs/in and 1.2 lbs/in, respectively. In particular, Sample C was comprised of 95 g/m$^2$ of Q-fiber®, while Sample D was comprised of 58 g/m$^2$ of Q-fiber®. In contrast, Samples F and G, comprised of Q-fiber® and coarse basalt fiber exhibited tensile strengths of 7.1 lbs/in and 3.5 lbs/in, respectively. In particular, Sample F was comprised of 23 g/m$^2$ of Q-fiber® and 47 g/m$^2$ of coarse basalt fiber (70 g/m$^2$ of total fiber), while Sample G was comprised of 20 g/m$^2$ of Q-fiber® and 20 g/m$^2$ of coarse basalt fiber (40 g/m$^2$ of total fiber). Thus, the samples with basalt have higher tensile strength at lower total weight. Further, Sample J, comprised of 37 g/m$^2$ of Q-fiber®, 37 g/m$^2$ of coarse basalt fiber, and 37 g/m$^2$ of high-iron content fiber (111 g/m$^2$ of total fiber), exhibited a tensile strength of 8.9 lbs/in.

Binder Compositions

A fire barrier mat in accordance with embodiments may be infused with a chemical binder. The binder binds together the fibers, and may impart sufficient mechanical strength to the mat to maintain the integrity of the mat during subsequent manufacturing steps, installation, and use. For example, when a cover film is laminated to the fire barrier mat, the mat should have sufficient tensile strength that the equipment used to perform the lamination does not tear or otherwise damage the fire barrier mat. Similarly, the binder may impart sufficient peel strength to the fibers so they resist delamination during handling. The binder may be applied in liquid form to the fibers, and then dried or cured to bind together the fibers in the mat. The resulting mat is preferably highly flexible, and still meets all pertinent performance specifications, for example flammability, flame spread, smoke generation, and other requirements for aircraft insulation as discussed above.

It has been discovered that binder formulations including one or more selected vinyl polymers can result in an advantageous balance between the various desired properties of a high temperature resistant non-woven mat. The particular vinyl component used can be selected to tailor such properties as strength, flexibility, flammability, and smoke generation.

Examples of vinyl components that may be used, alone or in combination include ethylene vinyl chloride (EVCI), ethylene vinyl acetate (EVA), polyvinyl chloride (PVC), polyvinylidene chloride (PVDC), among other vinyl components.

If needed, tensile strength and interlaminar peel strength can be increased with the addition of a strengthening component. The strengthening component may also keep the uncured binder composition evenly distributed through the fibers during the fabrication of the mat. Examples of strengthening components that may be used, alone or in combination, include melamine formaldehyde, urea formaldehyde, polyurethane, and/or organopolysiloxanes, among other suitable strengthening components. Strengthening components may further include polyfunctional aziridines such as CX-100, available from DSM NeoResins, Inc.

One or more additional crosslinking components may be also be added to the binder composition. Example crosslinkers may include a polyepoxy emulsion and/or polyaziridine compound, among others.

A surfactant may also be optionally included in the binder composition for improving binder distribution within the mat, resulting in improved interlaminar peel strength. Examples of surfactants that may be used, alone or in combination, include Emerest 2646 (i.e., 2-hydroxyethyl octadec-9-enoate) and other suitable surfactants. A water repellant, for example a fluoropolymer or silicone water repellant, may be added to improve resistance to water absorption. Other additives may also be used, for example a flame retardant. A silicone water repellant may include reactive silicone, silicone oil, or a combination of these.

Table 2 below lists possible binder formulations, showing relative proportions of the various components as weight percentages.

TABLE 2

| Binder Component | Weight % |
|---|---|
| Vinyl component | 60 to 100 |
| Melamine formaldehyde | 0 to 40 |
| Polyurethane | 0 to 40 |
| Crosslinker | 0 to 20 |
| Water repellant | 0 to 10 |
| Surfactant | 0 to 5 |

Table 3 lists a formulation where the vinyl component is ethylene vinyl chloride (EVCI):

TABLE 3

| Binder Component | Weight % |
|---|---|
| EVCl | 60 to 100 |
| Melamine formaldehyde | 0 to 40 |
| Fluoropolymer water repellant | 0 to 5 |
| Surfactant | 0 to 2 |

Table 4 lists an additional binder composition formulation that includes EVCI:

TABLE 4

| Binder Component | Weight % |
|---|---|
| EVCl | 70 to 90 |
| Melamine formaldehyde | 10 to 30 |
| Fluoropolymer water repellant | 0 to 4 |
| Surfactant | 0 to 1 |

Binder should be present in the mat in sufficient quantity to achieve the desired mechanical properties, but excessive binder may result in undesirable properties, for example an increase in flammability of the mat. In example mats, the binder may comprise about 5 to about 35 percent of the total non-woven mat weight, such as ranges of about 10 to about 30 percent, or about 20 to about 25 percent, among other weight ranges. The binder content may be measured by measuring the "loss on ignition" (LOI), which measures the portion of the mat weight lost when the binder is burned away from the fibers.

Binders and mat fiber compositions as disclosed above may be combined to form the fire barrier mat. For example, a non-woven mat having a blend of small-diameter microfiber and larger-diameter chopped strand may be used. In one preferred embodiment, the small-diameter fiber is Johns Manville Q-Fiber™, and the larger-diameter chopped strand fiber is basalt based. In some embodiments, the mat may have a total basis weight of 25 to 75 grams per square meter.

A cover film may be placed adjacent either or both surfaces of the fire barrier mat, as is explained in more detail below.

Insulation Products

A fire barrier mat as herein disclosed may be combined with an insulation blanket to produce an insulation product suitable for aircraft or other uses. FIG. 1 illustrates a cross section of a first example insulation product 100 that comprises an insulation blanket 101 and a fire barrier mat 102. For example, insulation blanket 101 may be made from MICROLITE® AA, MICROLITE® AA Premium, and MICROLITE® AA Premium NR insulation, available from Johns Manville, Denver, Colo., or another kind of insulation. In some embodiments, insulation 101 and fire barrier mat 102 may be bonded together, using any suitable adhesive.

Figure 2:
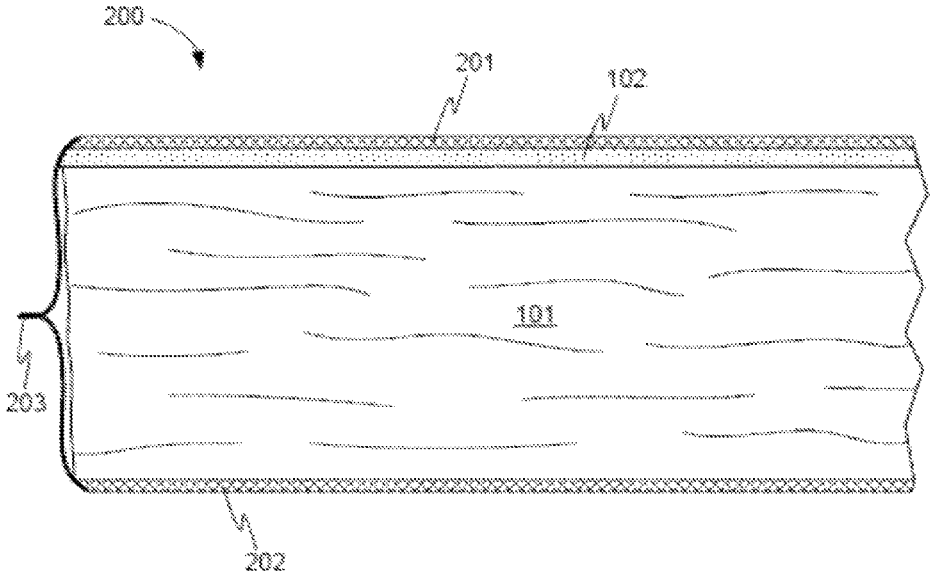
FIG. 2 illustrates an insulation product according to another embodiment, including a cover film.

In some embodiments, one or more cover films may be used. FIG. 2 illustrates an example insulation product 200, including cover films 201 and 202. In insulation product 200, cover films 201 and 202 are placed on the outer surfaces of insulation blanket 101 and fire barrier mat 102, such that insulation blanket 101 and fire barrier mat 102 are encapsulated between cover films 201 and 202. At the edges of insulation product 200, cover films 201 and 202 may be joined as shown at 203, for example by thermal or sonic sealing or another process. Cover films 201 and 202 may be, for example, polymer films comprising polyether ether ketone (PEEK), polyvinyl fluoride (available under the trade name Tedlar® from E.I. DuPont of Wilmington, Del.), an ethylene and chlorotrifluoroethylene copolymer (widely available under the trade name Halar®), or another suitable material. Either or both of cover films 201 and 202 may be bonded to its respective adjacent element, using any suitable adhesive.

Figure 3:
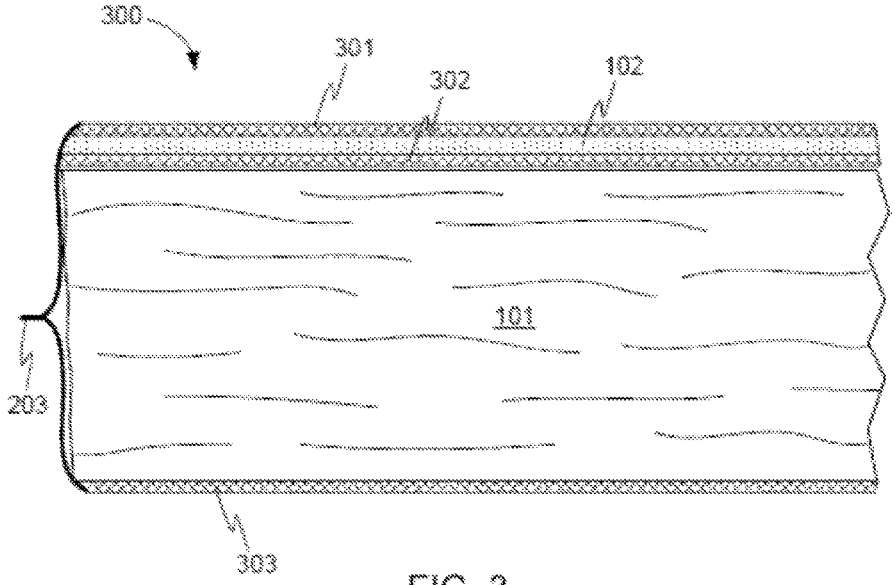
FIG. 3 illustrates an insulation product in accordance with another embodiment.

FIG. 3 illustrates an insulation product 300 in accordance with another embodiment. In example insulation product 300, fire barrier mat 102 is sandwiched between two cover films 301 and 302, and disposed at one surface of insulation blanket 101. A third cover film 303 is disposed at the other surface of insulation blanket 101. Cover films 301 and 302 may be bonded to fire barrier mat 302 using an adhesive, as is explained in more detail below.

Fire Barrier Mat Fabrication

A fire barrier mat in accordance with embodiments, may be produced by any suitable method. For example, such a mat may be advantageously produced using a wet laid process performed using equipment such as a Voith Hydroformer or a similar machine or process. Several improvements in traditional wet laid fabrication have been developed that facilitate the production of a mat especially suitable for use as a fire barrier mat in aircraft applications. For example, in order to prevent burnthrough of the mat, very uniform distribution of the fibers within the mat is desirable, without excess clumps of fibers, and the mat should be essentially free of holes or voids. This desire for uniformity dictates a very uniform dispersion of fibers in the mixing tank of the wet laid process.

Figure 4:
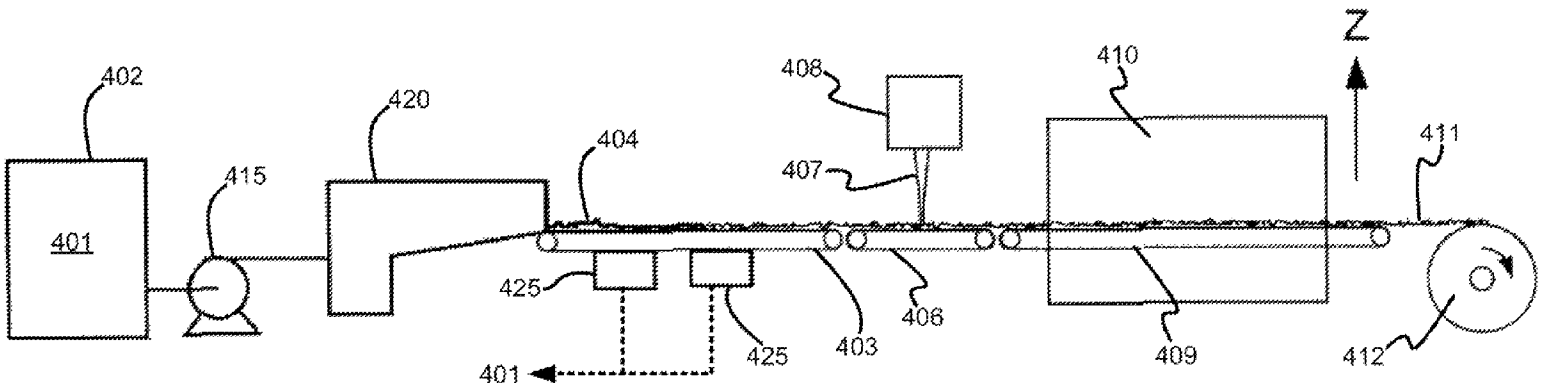
FIG. 4 illustrates a simplified schematic view of an example process for producing a fire barrier mat.

FIG. 4 illustrates a simplified schematic view of one example process for producing a fire barrier mat. In the process of FIG. 4, glass fibers are combined with whitewater 401 to form an aqueous suspension in mixing tank 402. The whitewater 401 may be a water-based mixture for treating the fibers to improve the quality and uniformity of the fire barrier mat. The whitewater may include one or more thickening agents and/or dispersants that promote the homogeneity and/or cohesion of the fibers in the suspension and subsequently in the mat. Exemplary thickening agents may include hydroxyethyl cellulose containing agents such those available from Hercules, Inc. Exemplary dispersants may include cationic surfactants such as ethoxylated tallow amines available from Cytec Industries, Inc. The pH of the suspension may be any acceptable pH for the processing conditions (e.g., less than 7, about 4 to about 7, etc.) and may be adjusted by the addition of acids or bases (e.g., acetic acid).

When both fine and coarse fibers are used in the mat, the two fiber diameters may present competing interests to the formulation of the white water chemistry. For example, long, coarse fibers may be more effectively dispersed in a more viscous white water. However, the presence of the fine fibers may make it difficult to remove a relatively viscous white water from the mat in later stages of the wet laid process. The selected white water formulation and fiber mix preferably balance these interests. In one example embodiment, the viscosity of the white water is about 4-5 centipoises.

It has also been discovered that the moisture content of the fine fiber at the time it is introduced into the wet laid process has a strong effect on the uniformity of the finished mat. In particular, introducing the fine fiber to the wet laid process in an already-wet state improves the dispersion of the fibers in the white water mixture, and results in a more uniform mat. Advantageously, the already-wet fine fiber may be obtained by modifying the process by which the fine fiber is produced. For example, some fine fiber (such as Q-Fiber™) is made in a production process that includes leaching utilizing large amounts of water. Such fine fiber has been typically centrifuged and oven dried, and sold as a dried product. In accordance with embodiments, the fine fiber production process may be interrupted after the centrifuge step, so that the fine fiber is not oven dried. In this stage, the fine fiber may have, for example, a moisture content of about 5 to 75 percent, or preferably about 5 to 35 percent. This already-wet fiber is then introduced into tank 402 of the wet laid process, for mixing with the white water 401 and any coarse fibers.

A pump 415 transfers the white water 401 and fibers 404 from the tank 402 to a headbox 420, where the fibers 404 are laid onto a first belt 403. With the aid of suction via one or more suction boxes 425, white water 401 is drawn through first belt 403 and returned to tank 402. Preferably, tank 402 is replenished with fibers and liquid as needed to maintain a proper mixture of fibers and white water 401 for continuous production.

Fibers 404 may be transferred to a second belt 406, for application of a binder. In FIG. 4, binder 407 is shown as being applied to fibers 404 using a curtain coater 408. Other binder application techniques may be used as well. For example, binder 407 may be sprayed onto fibers 404, or applied by another suitable technique. Binder 407 may include a vinyl component and a strengthening component, in an aqueous emulsion for convenient application.

Fibers 404, now including binder 407, may then be transferred to a third belt 409 and carried through a drying process 410. Drying process 410 may use heat, airflow, or other techniques to cure binder 407 and to remove moisture from fibers 404. Drum drying/curing can also be used in place of through air drying/curing. After drying, completed mat 411 may be packaged for later use, for example by being wound onto a roll 412.

It has also been discovered that the distribution of binder within the finished mat 411 in the Z direction as shown in FIG. 4 has a significant effect on the quality and later processing of mat 411. If the binder is not infused throughout mat 411, mat 411 may suffer from poor interlaminar strength. Excessive binder at or near either surface of mat 411 may also interfere with proper bonding of any cover film added later to mat 411. Even if curtain coater 408 infuses fibers 404 with sufficient binder, curing and drying process 410 may cause migration of binder to the upper side of mat 411 due to nonuniform heating. For example, if one side of mat 411 is dried more rapidly than the other, still-uncured binder may migrate toward the drying side. To mitigate this problem, it has been found that using a binder emulsion having a relatively high solids content can reduce the binder migration during curing. To further facilitate uniform dispersion of the binder within the mat, a surfactant may also be added to the binder formulation. In addition, curing and drying process 410 may be carried out in stages or zones. For example, the first zone or zones of an oven that is part of curing and drying process 410 may be operated at a decreased temperature, slowing the drying of fibers 404 and the migration of binder to the heated side of mat 411. Later oven zones are preferably still maintained at sufficient temperatures to fully dry and cure mat 411.

Figure 5:
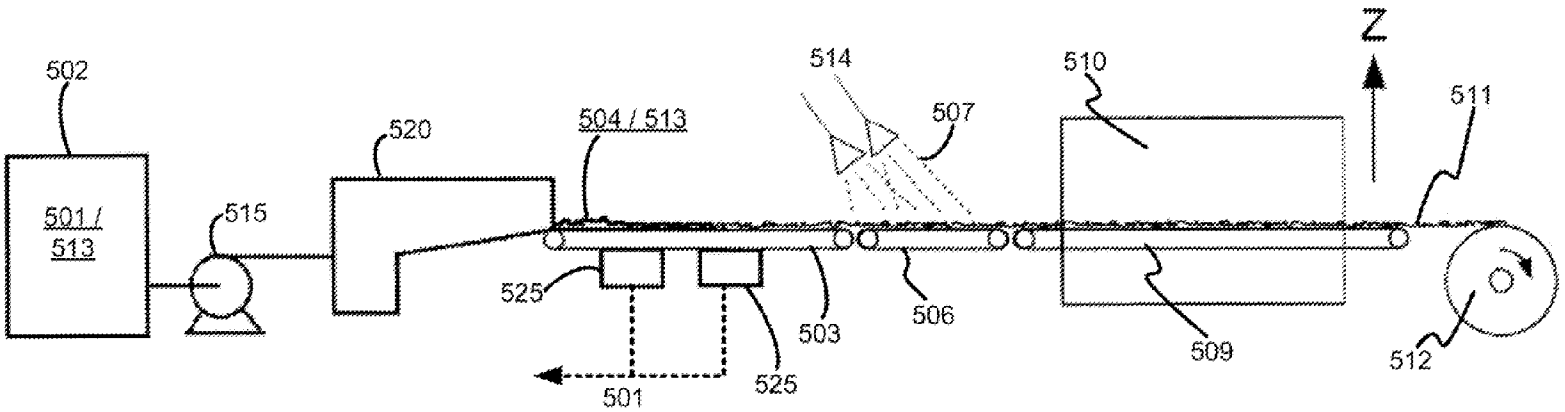
FIG. 5 illustrates a simplified schematic view of a further example process for producing a fire barrier mat.

FIG. 5 illustrates a simplified schematic view of a further example process for producing a fire barrier mat. In the process of FIG. 5, glass fibers are combined with water 501 to form an aqueous suspension in mixing tank 502.

In this embodiment, at least one first binder 513 is included in the water 501 so that it will be incorporated into the fiber matrix when the fibers 504 are laid onto a first belt 503. Suitable first binder 513 formulations include, but are not limited to, the vinyl polymers described above, including ethylene vinyl chloride (EVCI), ethylene vinyl acetate (EVA), polyvinyl chloride (PVC), polyvinylidene chloride (PVDC), and combinations thereof, among other vinyl components. In certain embodiments, ethylene vinyl chloride (EVCI) is added to the water 501.

In embodiments such as those illustrated in FIG. 5 in which a first binder 513 such as a vinyl polymer is included in the water 501, a pump 515 transfers the water 501, first binder 513 and fibers 504 from the tank 502 to a headbox 520, where the first binder 513 and fibers 504 are laid onto first belt 503. With the aid of suction via one or more suction boxes 525, water 501 is drawn through first belt 503 and returned to tank 502. The first binder 513 is thus incorporated into the fiber matrix during initial formation of the matrix. Preferably, tank 502 is replenished with fibers, first binder 513 and liquid as needed to maintain a proper mixture of fibers, first binder 513 and water 501 for continuous production.

The first binder 513, however, is initially a colloidal suspension in the aqueous solution in the tank 502. In this form, the first binder 513 would undesirably remain in the water 501 when the headbox 520 lays the fibers 504 onto first belt 503, and would thus be removed with the water 501 by the suction boxes 525. In order to ensure that the first binder 513 comes out of solution and onto first belt 503 with the fibers 504, a beater addition process may be used. In such a process, the pH of the aqueous solution is adjusted by adding an acidic or basic composition to the water until the first binder 513 flocculates from the water. The first binder 513 would thus leave the solution and become part of the glass fiber matrix on the first belt 503. In an embodiment in which a vinyl polymer such as EVCI is used as the first binder 513, an aqueous solution of aluminum sulfate (alum) may be added to the water 501 until the pH is reduced to less than about 4. In these conditions, the EVCI will flocculate from the solution and into the fibers on the first belt 504.

While embodiments described above indicate that the water 501 includes glass fibers and at least one first binder 513, the water 501 may also include whitewater as described above in other embodiments. Thus, in addition to the glass fibers and first binder 513, the water 501 may include other one or more thickening agents and/or dispersants that promote the homogeneity and/or cohesion of the fibers in the suspension and subsequently in the mat. Exemplary thickening agents may include hydroxyethyl cellulose containing agents available from Hercules, Inc. Exemplary dispersants may include cationic surfactants such as ethoxylated tallow amines available from Cytec Industries, Inc. In one example embodiment, the viscosity of the water is about 2-5 centipoises. It may be desirable, however, for the water 501 not to include whitewater or other additives, or at least to minimize the use of the whitewater/additives, as the additional additives may adversely affect the flocculation of the first binder 513 from the water 501, preventing the first binder 513 from forming onto the first belt 503 with the fibers 504.

Fibers 504 and first binder 513 may be transferred to a second belt 506, for application of a second binder 507. In FIG. 5, a second binder 507 is shown as being applied to the fibers 504 and first binder 513 in a spray process 514. In exemplary embodiments illustrated in FIG. 5, the second binder 507 is a strengthening component such as those described above. Examples of strengthening components that may be used, alone or in combination, include melamine formaldehyde, urea formaldehyde, polyurethane, and/or organopolysiloxanes, among other suitable strengthening components. Strengthening components may further include a polyfunctional aziridine. In certain embodiments, the second binder 507 is melamine formaldehyde and is added to the fibers 504 and first binder 513 as an aqueous solution.

Fibers 504, now including the first binder 513 and second binder 507, may then be transferred to a third belt 509 and carried through a drying process 510. Drying process 510 may use heat, airflow, or other techniques to cure the first binder 513 and second binder 507 and to remove moisture from fibers 504. Drum drying/curing can also be used in place of through air drying/curing. After drying, completed mat 511 may be packaged for later use, for example by being wound onto a roll 512. Many variations are possible. For example, more or fewer belts may be used. In other embodiments, the second binder 507 may be added to the mat after the first binder 513 is cured.

A mat formed according to the processes described above may thus include two binders. In some embodiments, the finished mat (i.e., following drying/curing) may contain from around 8-25% by weight of the first binder, more preferably from around 9-23% by weight of the first binder or from around 10-20% by weight of the first binder. In certain embodiments, the finished mat may contain from around 2-22% by weight of the second binder and more preferably from around 4-16% by weight of the second binder or from around 5-15% by weight of the second binder. In yet other embodiments, the finished mat may have a total binder content of from around 10-30% by weight, and more preferably from around 13-27% by weight or from around 15-24% by weight.

It has also been discovered that the distribution of binder within the finished mat 411/511 in the Z direction as shown in FIGS. 4 and 5 has a significant effect on the quality and later processing of mat 411/511. If the binder is not infused throughout mat 411/511, mat 411/511 may suffer from poor interlaminar strength. Excessive binder at or near either surface of mat 411/511 may also interfere with proper bonding of any cover film added later to mat 411/511. Even if, for example, curtain coater 408 infuses fibers 404 with sufficient binder, the curing and drying process 410 may cause migration of binder to the upper side of mat 411 due to nonuniform heating. For example, if one side of mat 411 is dried more rapidly than the other, still-uncured binder may migrate toward the drying side. The same may occur with a mat 511 formed from the beater addition and spray process illustrated in FIG. 5. To mitigate this problem, it has been found that using a binder emulsion having a relatively high solids content can reduce the binder migration during curing. To further facilitate uniform dispersion of the binder within the mat, a surfactant may also be added to the binder formulation. In addition, curing and drying process 410/510 may be carried out in stages or zones. For example, the first zone or zones of an oven that is part of curing and drying process 410/510 may be operated at a decreased temperature, slowing the drying of fibers 404/504 and the migration of binder to the heated side of mat 411/511. Later oven zones are preferably still maintained at sufficient temperatures to fully dry and cure mat 411/511.

In addition, the particular mix of fine and coarse fibers may be selected to balance the performance requirements of the finished product with the capabilities of the wet lay process. In general, a higher proportion of fine fiber in the mats result in better burnthrough performance. However, a mat having a high proportion of fine fibers may be difficult to produce, as it may be difficult to remove excess water from the fibers in some processes. The particular mix of fine and coarse fibers also largely determines the air permeability of the final mat, which relates to the ability of the mat to shed water during the wet lay process. Air permeability may be conveniently measured, for example, using a Frazier Air Permeability instrument, maintaining a constant pressure differential between the sides of a sample, and measuring the amount of air flowing through the sample per unit of area. It has been discovered that a mat having an air permeability of as high as 50-100 cfm/ft$^2$/min (measured at 0.5 inches of water pressure differential) can have sufficient burnthrough performance, and yet be permeable enough to enable production on a variety of wet-lay equipment. Mats with lower air permeability may be used, and would be expected to have superior burnthrough performance, but may not be producible on some wet-lay equipment, or their rate of production may be limited by the ability of the particular wet-lay equipment to remove water from the mat.

In some embodiments, a mat includes silica microfiber, such as Johns Manville Q-Fiber™, at a basis weight of at least 10 g/m$^2$, and preferably at least 15 g/m$^2$, for good burnthrough performance. It has been noted that a basis weight of at least 25 g/m$^2$, may result in a mat that is difficult or slower to process on some equipment, but such basis weights may be used if desired. A mat according to some embodiments also includes chopped strand, for example basalt chopped strand, at a basis weight of at least 10 g/m$^2$, and preferably at least 15 g/m$^2$, for sufficient wet strength in processing and final non-woven product strength.

A mat may be characterized by the ratio of chopped strand to fine fiber. A high ratio of chopped strand to fine fiber may result in a structure that is too porous, with poor burnthrough performance. To maintain good burnthrough performance, the amount of chopped strand preferably is 70 percent or less of the total fiber content by weight. In preferred embodiments, it is found that a non-woven mat with a silica microfiber content of 16-22 g/m$^2$ and a basalt chopped strand content of 16-22 g/m$^2$ can effectively pass the FAA-specified burnthrough tests, and also meet aircraft weight requirements. With a binder content of 15-25 weight percent, such a burnthrough resistant mat would have a total basis weight of about 37-60 g/m$^2$.

The water repellency and moisture pickup characteristics of the mat may also be of interest, especially in aerospace applications. Various water repellants and application techniques may be used. For example fluoropolymers or silicones may be applied to the finished mat. However, it has been found that a particularly effective water repellant is a fluoropolymer added directly to the binder.

In some embodiments, a fire barrier mat may include polymer fibers. Polymer fibers may be made, for example, of polyvinyl acetate, polyester, or another suitable material or a blend of materials. Such polymer fibers may at least partially fuse during the drying or curing of the mat, and may contribute to the strength of the mat. Accordingly, it may be possible to reduce the amount of other materials used in the mat. For example, the binder content of the mat might be reduced as compared with a mat that includes only glass fibers, or the amount of course fiber may be reduced in comparison with a mat without polymer fibers.

Table 5 below shows the results of tests comparing the moisture pickup of a mat without water repellant to the moisture pickup of a mat produced using a fluoropolymer introduced into the binder formulation. The fiber blend was 50% silica microfiber (Q-Fiber™) and 50% basalt chopped strand. The binder formula was 73% ethylene vinyl chloride and 27% melamine formaldehyde. In all three test cases the small amount of fluoropolymer in the binder reduced the moisture pickup. The moisture pickup reduction due to the fluoropolymer was most dramatic in non-woven samples that had polymer films laminated to both sides. It was also found that increasing the amount of fluoropolymer up to 10% by weight of the binder increased the moisture resistance without having a detrimental effect on the ability to laminate polymer films to the non-woven. It is believed that even higher amounts of water repellent could be added to the non-woven as a post treatment to increase the water resistance and reduce moisture pickup even further.

TABLE 5

| | Bare nonwoven (% weight gain in water for 10 minutes) | | Nonwoven laminated on both sides to polymer films (% weight gain in water |
|---|---|---|---|
| Sample | Air dried | Blotted | for 20 minutes) |
| No water repellent | 72 | 25 | 62 |
| Fluoropolymer (1% of binder weight) | 60 | 21 | 12 |

Many other variations are possible for producing fire barrier mats according to embodiments. For example, the wet lay process may utilize a flat wire process. In other embodiments, a fire barrier mat may be produced on a fourdrinier machine or similar machine used in papermaking, or using a rotoforming process. In any process involving dispersing fibers in liquid, the binder may be included in the liquid. The mat may be dried in other ways as well, for example by drum drying in place of the through air drying method illustrated in the figures.

Experimental Mats

Tables 6 and 7 below show test results on a number of non-woven fire barrier mats, produced using different binder formulations and amounts. The mats described in Table 6 use binders comprising ethylene vinyl chloride (EVCl), while the mats described in Table 7 use binders comprising ethylene vinyl acetate (EVA). The reported peel strength is the force required to delaminate a three-inch wide strip of the mat. Tensile strength is the force required to part a one-inch wide strip. Stiffness is measured by the Taber method as the torque (in g-cm) required to bend the paper 15 degrees. The test for flammability is as described in §25.856 and 14 C.F.R. §25, Appendix F, Part VII and Advisory Circular 25.856-2A. Smoke density is measured in accordance with BSS 7238 (ASTM E662) to comply with FAA and aircraft manufacturer requirements.

TABLE 6

Binders with EVCl

| Sample | EVCl (wt % of binder) | Melamine Formal-dehyde (wt % of binder) | Binder content (wt % of total mat) | Tensile Strength (lbs/in) | Peel Strength (lbs) | Stiffness (g-cm) | Flamm-ability | Smoke Density (NBS Chamber) |
|---|---|---|---|---|---|---|---|---|
| 1 | 77 | 23 | 24.0 | 10.0 | 1.1 | 3.5 | Pass | |
| 2 | 77 | 23 | 21.3 | 14.7 | 0.6 | 5.0 | Pass | 8.1 |
| 3 | 77 | 23 | 22.4 | 11.9 | 0.5 | 5.0 | Pass | 7.6 |
| 4 | 77 | 23 | 15.0 | 7.7 | <0.1 | 2.8 | Pass | 6.0 |
| 5 | 77 | 23 | 14.8 | 7.0 | <0.1 | 3.5 | Pass | 6.2 |
| 6 | 87 | 13 | 20.1 | 10.5 | 1.5 | 4.5 | Pass | 7.6 |
| 7 | 87 | 13 | 15.1 | 5.7 | <0.1 | 3.0 | Pass | 7.1 |
| 8 | 100 | 0 | 23.7 | 7.4 | 0.6 | 3.5 | Pass | 8.4 |
| 9 | 100 | 0 | 15.9 | 5.9 | <0.1 | 2.0 | Pass | |

TABLE 7

Binders with EVA

| Sample | EVA (wt % of binder) | Melamine Formal-dehyde (wt % of binder) | Binder content (wt % of total mat) | Tensile Strength (lbs/in) | Peel Strength (lbs) | Stiffness (g-cm) | Flamm-ability | Smoke Density (NBS Chamber) |
|---|---|---|---|---|---|---|---|---|
| 10 | 73 | 27 | 24.4 | 6.2 | 0.2 | 1.3 | Fail | 7.0 |
| 11 | 73 | 27 | 22.8 | 9.7 | 0.3 | 2.5 | Fail | |
| 12 | 73 | 27 | 16.8 | 6.0 | <0.1 | 1.0 | Pass | 5.9 |
| 13 | 87 | 13 | 22.9 | 15.3 | | 4.8 | Fail | 5.6 |
| 14 | 87 | 13 | 16.5 | 7.2 | <0.1 | 2.3 | Fail | |
| 15 | 100 | 0 | 25.3 | 10.7 | 0.2 | 3.3 | Fail | |
| 16 | 100 | 0 | 15.9 | 4.7 | <0.1 | 1.3 | Fail | 5.4 |

All of the data in Tables 6 and 7 was generated using mats with basis weights between 50 and 60 g/m$^2$, with a fiber blend of 50 percent silica microfiber (Q-Fiber™) and 50 percent basalt chopped strand. As can be observed from Tables 6 and 7, a binder using EVCI may provide improved flammability resistance and peel strength as compared with a binder using EVA. The chorine content of the EVCI may contribute to the low flammability. The addition of melamine formaldehyde improves the tensile strength and especially the peel strength by strengthening the binder system. Because of its nitrogen content, it does so without causing failure in the flammability test.

Tables 8A and 8B below show the results of tests performed on mats in which a first binder (EVCI) is formed with the fibers in a beater addition process and a second binder (melamine formaldehyde, "MF") is later added in a spray process as described above.

TABLE 8A

EVCl Binder (from beater addition) and MF (from spray)

| Sample No. | Fiber Composition | Binder Composition/ method of addition | Weight (gm/ft$^2$) | Tensile strength (lbs/3") (machine direction) | Peel (lbs) |
|---|---|---|---|---|---|
| 1 (Control; no MF) | 50% 1/4" 13μ basalt 50% Q-Fiber ™ | 100% EVCl-Beater add | 4.95 | 7.5 | 0.614 |
| 2 (Control; curtain coated) | 50% 1/4" 13μ basalt 50% Q-Fiber ™ | 75% EVCl-25% MF (curtain coated) | 4.93 | 16.2 | 0.376 |
| 3 | 50% 1/4" 13μ basalt 50% Q-Fiber ™ | 100% EVCl-Beater add 5% MF solution-spray | 4.42 | 9.1 | 0.346 |
| 4 | 50% 1/4" 13μ basalt 50% Q-Fiber ™ | 100% EVCl-Beater add 5% MF solution-spray | 4.72 | 8.8 | 0.365 |
| 5 | 50% 1/4" 13μ basalt 50% Q-Fiber ™ | 100% EVCl-Beater add 5% MF solution-spray | 4.68 | 7.7 | 0.218 |
| 6 | 25% 1/2" 16μ basalt 25% 1/4" 13μ basalt 50% Q-Fiber ™ | 100% EVCl-Beater add 5% MF solution-spray | 4.91 | 10.5 | 0.455 |

TABLE 8B

EVCl Binder (from beater addition) and MF (from spray)

| Sample No. | LOI (%) | Tensile/ binder wt | Burn-through flame test 128.5 g (min) | Total Weight of binder (gm/ft$^2$) | Weight of EVCl (gm/ft$^2$) | Weight of MF (gm/ft$^2$) |
|---|---|---|---|---|---|---|
| 1 (Control; no MF) | 24.4 | 6.21 | <2 sec | 1.208 | 1.208 | 0 |
| 2 (Control; curtain coated) | 18.6 | 17.67 | >4 | 0.917 | 0.688 | 0.229 |

TABLE 8B-continued

EVCl Binder (from beater addition) and MF (from spray)

| Sample No. | LOI (%) | Tensile/ binder wt | Burn-through flame test 128.5 g (min) | Total Weight of binder (gm/ft$^2$) | Weight of EVCl (gm/ft$^2$) | Weight of MF (gm/ft$^2$) |
|---|---|---|---|---|---|---|
| 3 | 17.1 | 12.04 | >4 | 0.756 | 0.535 | 0.221 |
| 4 | 16.5 | 11.3 | >4 | 0.779 | 0.543 | 0.236 |
| 5 | 15.5 | 10.61 | >4 | 0.725 | 0.491 | 0.234 |
| 6 | 17.7 | 12.08 | >4 | 0.869 | 0.624 | 0.246 |

Samples 1 and 2 are control samples. Sample 1 shows test results of a mat formed with only an EVCI binder applied to the mat in a beater addition process as explained above. Sample 2 shows test results of a mat formed with an EVCI and MF binder applied in a curtain coating process as explained above. Samples 3-6 show test results of a mat formed with EVCI applied in a beater addition process and MF applied in a spray process. The Q-Fiber™ is available from Johns Manville. The EVCI is available from Wacker Chemie AG and the MF is available from Emerald Performance Materials. The EVCI binder content in the dried mat in samples 3-6 ranges from 10.5-12.7% by weight (weight of EVCI/total weight of sample×100). The MF binder content in the dried mat in these samples is 5% by weight (weight of MF/total weight of sample×100). The total binder content in the dried mat thus ranges from 15.5-17.7% by weight (total weight EVCI and MF/total weight of sample×100).

Tensile strength is measured on a 3-inch strip in the machine direction. Tensile/binder weight in Table 8B shows the tensile strength as a function of total weight of binder in the mat (total of binder is provided Table 8B). Total weight of EVCI and MF in the finished mat is provided in Table 8B.

The burnthrough test is performed according to the following procedure:

- In the machine direction, cut a 6" strip of flame barrier mat by 2" wide using a paper cutter.
- Tape a weight to a large binder clip and hang the weight/binder clip to the bottom of the sample. As listed in Table 8B above, a 128.5 g weight was used in these examples.
- Carefully clip the sample (with weight attached) to a stand (so as not to place any extra force on the fibers that will weaken them).
- Place a propane torch directly in front of the sample, at a distance of 2.5"+/−0.25" from the sample. Center the nozzle of the torch along the width of the sample.
- Light the torch, and start a timer.
- Measure the time required for the sample to break and fall from the stand. A passing sample will last for at least 4 minutes before breaking apart.

As can be seen in Tables 8A and 8B, samples 3-6, containing EVCI binder applied in a beater addition process and MF applied as a spray, showed similar burnthrough resistance properties as sample 2, where there the binders were applied in a curtain coating process. This validates the use of a two-stage process for applying the binders to the mat.

It can also be seen that a mat including MF (samples 2-6) has substantially improved properties as compared to one without MF (sample 1): the samples including MF had improved tensile strength (per binder weight), they all passed the burnthrough flame test, and they had less loss on ignition (LOI). This suggests that it could be useful to include MF (or other similar binders described above) during formation of the mat.

Integration with Lamination Process

In some embodiments, the lamination process used to place cover films on the fire barrier mat may be used in cooperation with the mat formulation. For example, the adhesive used to bond a cover film or films to the fire barrier mat may complement the binder in the mat, to provide beneficial properties at lower cost than would otherwise be possible, or to permit more flexibility in the mat manufacturing process.

In some embodiments, sufficient adhesive may be used to bond cover films to the mat that the adhesive can at least partially infuse the fibers in the mat. The adhesive may impart tensile or peel strength, and may allow a reduction in the amount of binder used. In some embodiments, the adhesive may enable a binder content of less than 15 weight percent of the total mat. In addition, a fire retardant may be added to the adhesive, to further improve the flammability rating of the mat. Similarly, a water repellant may be added to the adhesive, to supplement the water repellency of the mat, or to permit the use of a binder formulation that alone may not have sufficient water repellency.

The added strength imparted by the cover film adhesive may enable the use of other binder formulations that might otherwise may not provide satisfactory performance. For example, as can be seen in Table 7 above, some binders using ethylene vinyl acetate (EVA) may not have good peel strength, and may have poor flammability performance. The cover film adhesive may provide sufficient peel strength to enable the use of an EVA-based binder, especially if the adhesive includes a flame retardant. Other binder materials that may be aided by the use of the cover film adhesive include polyvinyl acetate (PVA), polyvinyl chloride (PVC), and polyvinyl alcohol (PVOH).

Fire barrier mats produced with the non-woven materials listed as samples 1-3 of Table 6 and laminated to polymer cover films have been constructed and have passed the FAA insulation burnthrough test described above, and also performed well for flexibility, internal strength, flammability, smoke density, burst strength, puncture strength, and seal strength.

While various embodiments have been described, it is to be understood that variations and modifications may be resorted to as will be apparent to those skilled in the art. Such variations and modifications are to be considered within the purview and scope of the claims appended hereto.

What is claimed is:

1. A method of making a fire barrier mat, the method comprising:

providing fine glass fibers having an average diameter less than 4 microns;

providing coarse glass fibers having an average diameter greater than 6 microns;

forming a mat comprising the fine and coarse glass fibers using a wet lay process;

applying a first binder to the mat by:

combining the first binder in an aqueous solution with the fine and course glass fibers, the aqueous solution comprising a pH; and lowering the pH of the aqueous solution to less than about 4 to cause the first inner to flocculate into the mat during formation of the mat;

applying a second binder to the mat using a spray process; and drying the mat.

2. The method of claim 1, wherein the drying process also the first hinder and second binder.

3. The method of claim 1, wherein providing the fine glass fibers comprises providing the fine glass fibers bearing residual moisture from a prior process of production of the fine fibers, the residual moisture content of the fine fibers being between 5 and 75 percent.

4. The method of claim 1, further comprising providing a white water for the wet lay process, the white water comprising at least one thickener and at least one dispersant.

5. The method of claim 1, wherein drying the mat comprises:

partially drying the mat in a first oven stage at a first temperature; and further drying the mat in a second oven stage at a second temperature, the second temperature being higher than the first temperature.

6. The method of claim 1, wherein the first binder is a vinyl polymer.

7. The method of claim 6, wherein the vinyl polymer is selected from the group consisting of ethylene vinyl chloride, ethylene vinyl acetate, polyvinyl chloride, polyvinylidene chloride and combinations thereof.

8. The method of claim 6, wherein the first binder is ethylene vinyl chloride.

9. The method of claim 1, wherein the second binder is a strengthening component.

10. The method of claim 9, wherein the strengthening component is selected from the group consisting of melamine formaldehyde, urea formaldehyde, polyurethane, organopolysiloxanes and combinations thereof.

11. The method of claim 9, wherein the strengthening component is melamine formaldehyde.

12. The method of claim 1, wherein the second binder is sprayed onto the mat in an aqueous solution.

13. The method of claim 1, wherein the dried mat comprises from around 8-25% by weight of the first binder and from around 2-22% by weight of the second binder.

14. The method of claim 1, wherein the dried mat comprises from around 9-23% by weight of the first binder and from around 4-16% by weight of the second binder.

15. The method of claim 1, wherein the dried mat comprises from around 10-20% by weight of the first binder and from around 5-15% by weight of the second binder.

16. A method of making a fire barrier mat, the method comprising:

providing fine glass fibers having an average diameter less than 4 microns;

providing coarse glass fibers having an average diameter greater than 6 microns;

forming a mat comprising the fine and coarse glass fibers using a wet lay process;

applying a first binder comprising ethylene vinyl chloride to the mat by:

combining the first binder in an aqueous solution with the fine and course glass fibers, the aqueous solution comprising a pH; and lowering the pH of the aqueous solution to less than about 4 to cause the first binder to flocculate into the mat during formation of the mat;

applying a second binder comprising melamine formaldehyde to the mat using a spray process; and drying the mat, wherein the dried mat comprises from around 10-02% by weight ethylene vinyl chloride and from around 5-15% by weight melamine formaldehyde.

* * * * *